United States Patent [19]

Jankowski

[11] Patent Number: 5,038,889

[45] Date of Patent: Aug. 13, 1991

[54] SCAFFOLD ENCLOSURE

[76] Inventor: Steven R. Jankowski, 328 Nuzum Ave., Pittsburgh, Pa. 15210

[21] Appl. No.: 605,369

[22] Filed: Oct. 29, 1990

[51] Int. Cl.[5] ..... E04G 21/32

[52] U.S. Cl. ..... 182/129; 182/47; 182/138

[58] Field of Search ..... 182/129, 47, 138; 135/1 R

[56] References Cited

U.S. PATENT DOCUMENTS

| | | | |
|---|---|---|---|
| 3,007,541 | 11/1961 | Mast | 182/129 |
| 3,121,470 | 2/1964 | Stone et al. | 182/129 |
| 3,392,801 | 7/1968 | Gethmann | 182/129 |
| 3,529,860 | 9/1970 | Jelley | 287/189.36 |
| 3,566,991 | 3/1971 | Proulx | 182/129 |
| 3,586,126 | 6/1971 | Eickhof | 182/129 |
| 3,805,816 | 4/1974 | Nolte | 135/1 R |
| 3,995,715 | 12/1976 | Virtanen | 182/129 |
| 4,574,534 | 3/1986 | Beaton | 52/63 |
| 4,738,335 | 4/1988 | Ishii | 182/129 |
| 4,782,915 | 11/1988 | King | 182/129 |
| 4,805,735 | 2/1989 | Anderson | 182/138 |
| 4,823,418 | 4/1989 | Downs | 5/503 |
| 4,875,549 | 10/1989 | Denny et al. | 182/138 |

*Primary Examiner*—Reinaldo P. Machado

*Attorney, Agent, or Firm*—Webb, Burden, Ziesenheim & Webb

[57] ABSTRACT

A scaffold enclosure having a plurality of panels is disclosed. Each panel has a closure on a first lateral edge for securing that edge to an upright on the scaffolding. The closure can be straps having first and second flaps with hook and loop closures thereon for securing the straps to various sized uprights. Each panel also has fasteners, preferably continuous strips of hook and loop closures, on both its inner and outer surfaces at each edge. The panels are thus engageable on one another to form a scaffold enclosure with completely sealed seams. To facilitate installment, two types of panels, starter panels and continuing panels, are utilized, each having a particular arrangement of fasteners.

19 Claims, 3 Drawing Sheets

SCAFFOLD ENCLOSURE

BACKGROUND OF THE INVENTION

1. Field of the Invention

This invention relates to protective enclosures for scaffolding utilized by workmen at construction sites and, more particularly, to those enclosures which comprise a plurality of sheets or panels.

2. Description of the Prior Art

In the construction industry, it is frequently desirable to protect workmen and buildings under construction from the weather. Contractors normally erect scaffolding around the outside of the structure upon which the work is to be performed. Such scaffolding provides support for workmen and tools so that work may be done on the structure at elevated levels. Scaffold enclosures are generally applied to the outside of the scaffolding, after it has been erected, to create a weatherproof environment around the scaffold and the structure. Prior art scaffold enclosures have frequently been complicated and cumbersome, and they have required significant expense and time to erect. The enclosures have also been difficult to open or close as needed.

U.S. Pat. No. 3,805,816 to Nolte discloses a protective covering for sheltering all sides of a scaffold. A rectangular covering element has hook-shaped telescoping profile bars and clamping lugs on two sides thereof, while the opposite sides have slots for receiving connection cables. Vertically adjacent covering elements are pushed or slipped into each other by means of hook-shaped profile bars which are secured to the edge of each covering element and which telescope into one another. Clamping lugs hold adjacent bars together. Horizontally adjacent cover elements overlap one another and are attached to the vertical struts of the scaffold construction by means of individual connection cables fitted through slots and individually tied around the vertical strut. Alternatively, an alligator clip-like cable may be utilized for this purpose.

U.S. Pat. No. 3,121,470 to Stone, et al. discloses a protective covering for scaffolding which utilizes elongated strips of metal and spring-loaded clips for holding the metal strips in place on the scaffolding struts. The metal strips are placed to secure adjacent edges of elongated plastic covering to the vertical and/or horizontal struts. Alternatively, canvas may be used to form the protective covering.

U.S. Pat. No. 3,995,715 to Vertinen discloses a protective covering for scaffolding having a plurality of plastic sheets with bead portions at the edges thereof so that adjacent edges of the coverings are placed together with tubular profiles and pushed over the adjacent edges to encapture the beads and hold the protective sheets in place. The covering is assembled on the ground and lifted by crane to the appropriate height on the scaffolding.

U.S. Pat. No. 4,574,534 to Beaten discloses a tension enclosure system having a plurality of plastic or canvas panels which are mounted on cables connected to the structure. A connector for interconnecting adjacent panels includes an elongated body or rod which extends from the cables and which is inserted through a plurality of grommets located on the edges of adjacent panels. A C-shaped clamp may be provided on the rod for holding the rod on the cable. Horizontal safety cables may be threaded through the cables.

Various other protective closures are disclosed in U.S. Pat. Nos. 4,823,418; 4,875,549; 4,805,735 and 4,738,335. Clips for protective closures for scaffolding are disclosed in U.S. Pat. Nos. 4,782,915 and 3,529,860. Additionally, it is well known in the art to erect protective closures for scaffolding using a plurality of plastic sheets which are secured to the scaffolding by boards and nails.

The prior art scaffold enclosures thus involve complicated systems for erecting the enclosures and may require undue expense, such as hiring special carpentry crews to erect the scaffold enclosure. One prior art scaffold enclosure even requires the use of a crane.

It is therefore an object of the present invention to provide a scaffold enclosure which is easily erected on the scaffolding without the need for additional expense. It is also an object of the present invention to provide a scaffold enclosure which is conveniently opened and closed by the workmen as needed and which is both durable and reusable. It is a still further object of the present invention to provide a scaffold enclosure which does not require the use of tools for assembly.

SUMMARY OF THE INVENTION

Accordingly, I have invented a panel adapted to be mounted on a scaffold which includes a pair of spaced, vertical outer uprights. The panel includes a rectangular web having an inner surface, an outer surface, an upper edge, a lower edge and first and second lateral edges. The web is dimensioned to extend between the outer uprights of the scaffold, and the lateral edges are adapted to engage the outer uprights. The panel has closure means on the inner surface of the web along the first lateral edge for securing the web to at least one of the outer uprights. The panel also has fastener means on the outer surface of the web along the first lateral edge for fastening an adjacent panel to the first lateral edge. The panel also has fastener means along the second lateral edge for fastening the web to either another of the outer uprights or to an adjacent panel.

The fastener means along the second lateral edge may include closure means on the inner surface of the web for securing the web to another of the outer uprights, and the fastener means may further include a fastener on the outer surface of the web for fastening an adjacent panel to the second lateral edge. The panel may further include a fastener on the outer surface of the web along the upper edge for fastening an adjacent panel thereto, with a fastener on the inner surface along the lower edge for fastening an adjacent panel thereto. The fasteners on the outer surface may include one portion of a hook and loop closure and the fastener on the inner surface may include the other portion of a hook and loop closure. Alternatively, the fastener means along the second lateral edge may simply be a fastener on the inner surface of the web for fastening the web to an adjacent panel.

The closure means may include a strap having a first flap and a second flap, each flap having an inner surface and an outer surface, with one flap carrying one portion of a hook and loop closure on its inner surface and the other flap carrying the other portion of a hook and loop closure on its outer surface. The panel may include a central closure means on the inner surface at the interior of the web for securing the panel to a crossbrace fixed to the outer uprights and extending therebetween. The panel may also include a safety loop on the inner surface at the interior of the web having an anchor secured to the web and a flap with a central opening therein for receiving a safety cable. Finally, a skirt may be included, and the skirt may have a fastener on its outer surface for fastening the skirt to the lower edge of each panel, with the skirt adapted to extend downward from the lower edge to a base upon which the scaffolding is erected.

Other features and advantages of the present invention will become apparent from the following detailed description in conjunction with the accompanying drawings.

DETAILED DESCRIPTION OF THE PREFERRED EMBODIMENT

Figure 1:
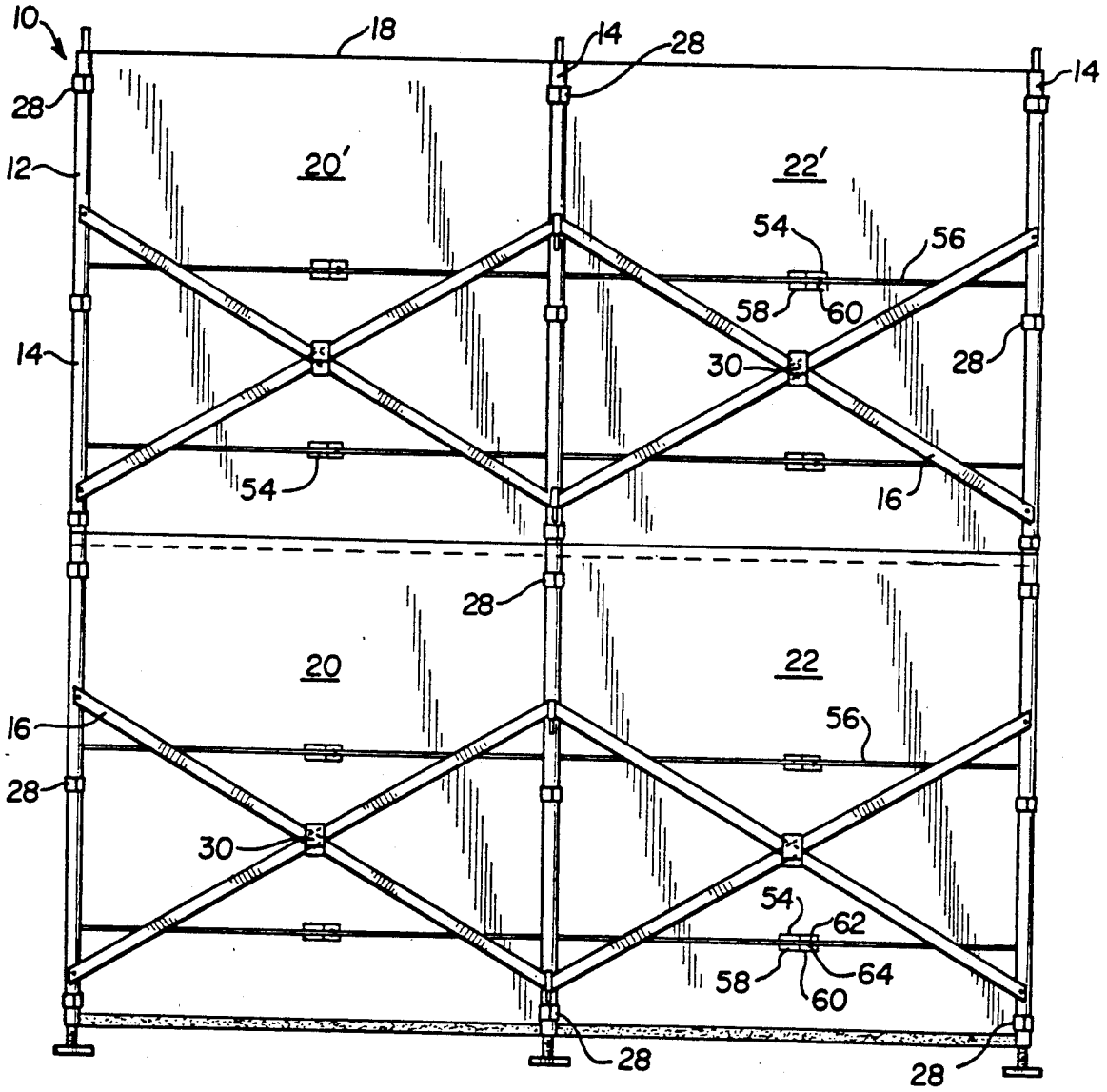
FIG. 1 is an inside view of an enclosed scaffolding in accordance with the present invention.

FIG. 1 shows an enclosed scaffolding 10 in accordance with the present invention. Each unit 12 of scaffolding has a pair of spaced, vertical outer uprights 14 with a pair of crossbraces 16 extending therebetween and attached to the outer uprights 14. Each outer upright 14 has a complementary inner upright (not shown) spaced therefrom and joined to a corresponding outer upright 14 by a plurality of rungs (not shown) to form a buck. Wooden or metal planks are laid across the uppermost rungs of each scaffold unit 12 to form a walkway for workmen who are performing construction tasks on the outside of a building within a work space created by the bucks and the crossbraces 16. The present invention provides an enclosure 18 for keeping the work space free from the effects of inclement weather. This allows work to be performed under almost any weather condition, reduces costs and expedites completion of construction work, and enhances the safety and comfort of construction workers. While a particular construction of a scaffold unit has been shown, it is to be understood that the present invention can be used with any scaffold.

The enclosure 18 includes a plurality of flat, rectangular webs or panels which are fastened to one another at adjacent edges and which are also secured to the outer uprights 14 and the crossbraces 16. To facilitate installment, two types of panels are utilized, namely a starter panel 20 and a continuing panel 22. Each panel has an inner surface shown in FIG. 1 and an outer surface shown in FIG. 2. The panels are made from a strong, lightweight fabric, such as canvas, which is highly resistant to tearing, effective in repelling wind and rain, and durable so that each panel may be repeatedly used at numerous construction sites. A plurality of closures, such as straps 28, are provided to secure the panels 20, 22 to the outer uprights 14 of the scaffold unit 12. Each panel 20, 22 has a central closure, such as the crossbrace strap 30, for securing the central area of each panel to the crossbraces 16. The straps 28, 30 will be discussed in further detail below.

Figure 5:
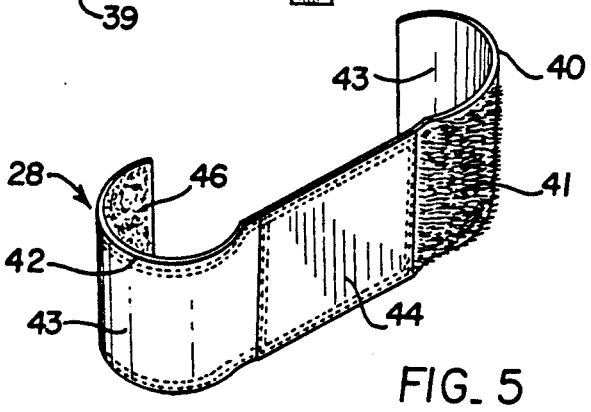
FIG. 5 is an enlarged view of the strap shown in FIGS. 1–4.
Figure 3:
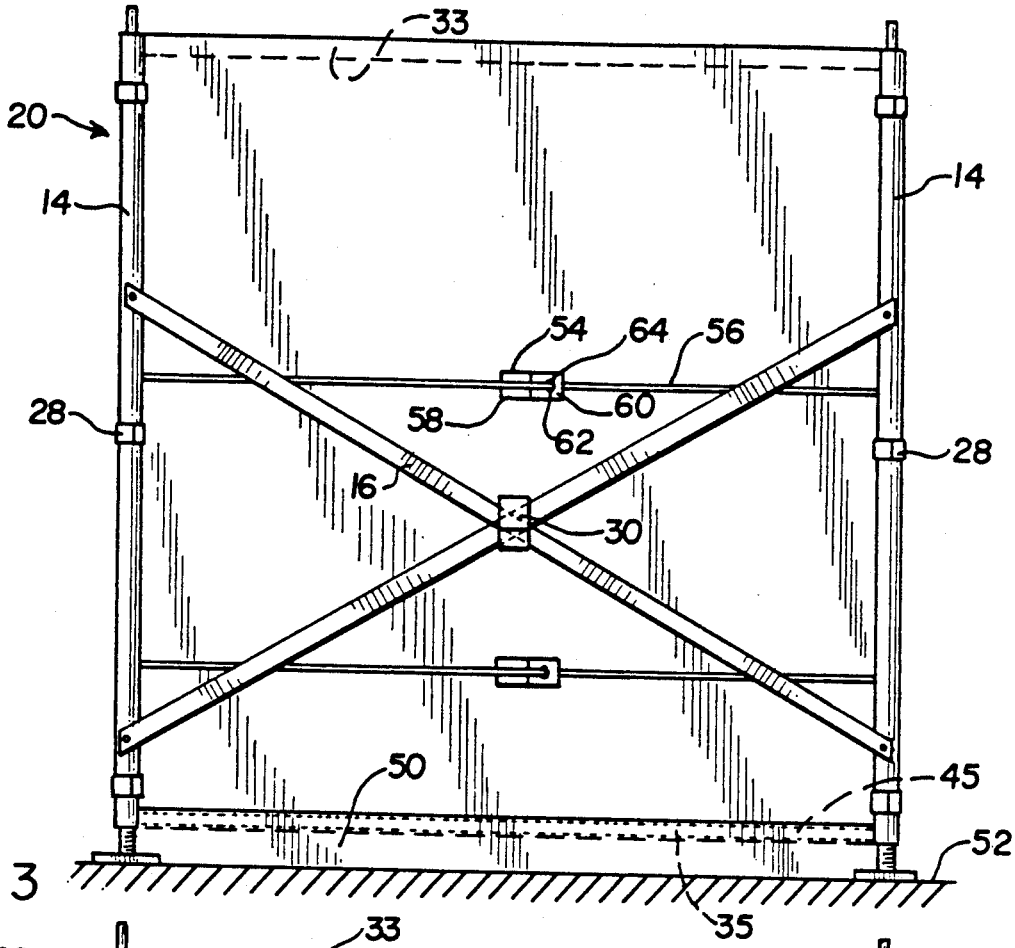
FIG. 3 is an inside view of a unit of scaffolding shown in FIG. 1 having a starter panel with a skirt attached thereto.
Figure 4:
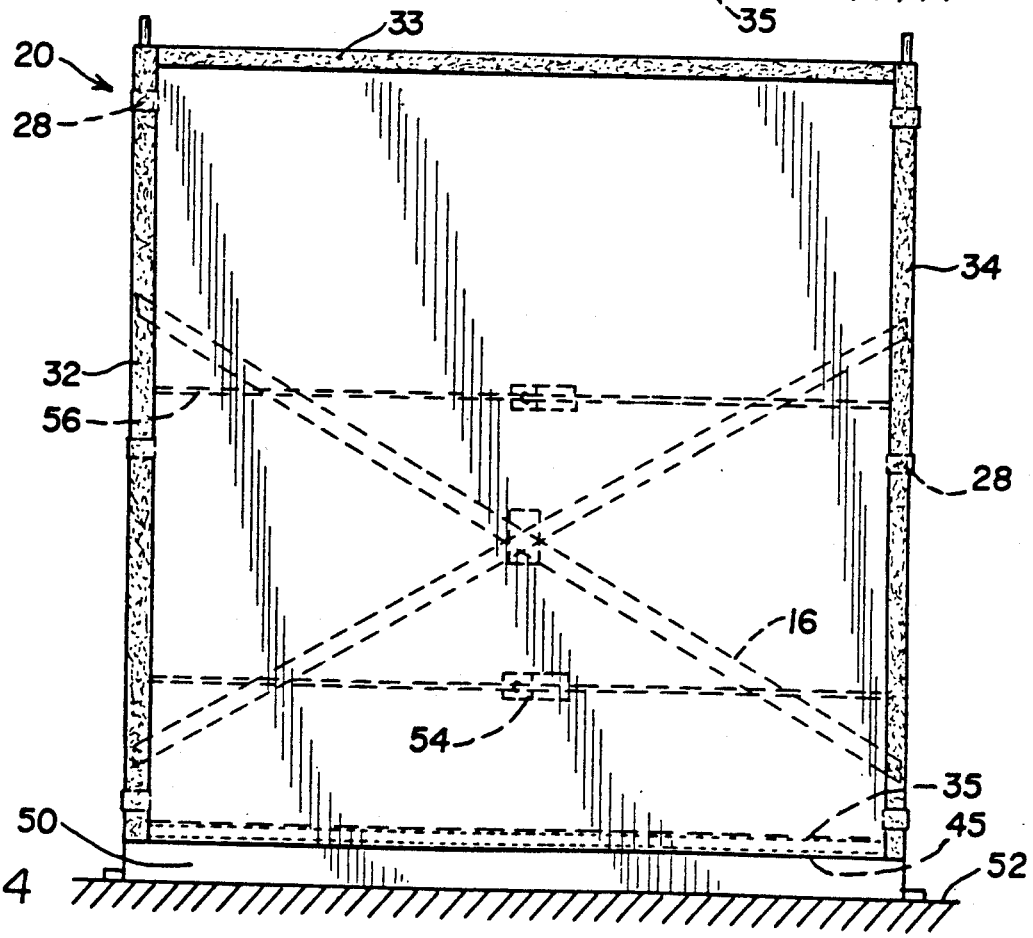
FIG. 4 is an outside view of the starter panel and scaffolding shown in FIG. 3.

Referring to FIGS. 3 and 4, the starter panel 20 has a first lateral edge and a second lateral edge along with an upper edge and a lower edge. Each starter panel 20 has three straps 28 equally spaced along the first lateral edge and three straps 28 equally spaced along the second lateral edge. The straps 28 are shown in more detail in FIG. 5. Each strap 28 has a first flap 40 and a second flap 42 with an anchor 44 that is secured to the inner surface of the starter panel 20. The anchor 44 is integral with the flaps 40, 42. The anchor 44 is double-stitched to the inner surface 24 and is preferably a double layer of canvas or other suitable backing material. The first flap 40 includes a hook portion 41 of a hook and loop closure on its outer surface with a canvas backing material 43 on its inner surface. The second flap 42 has a loop portion 46 of a hook and loop closure on its inner surface and the canvas backing material 43 on its outer surface. The hook and loop closures 41, 46 are attached by double-stitching to the canvas backing material of each flap 40, 42.

Referring once again to FIGS. and 2, the crossbrace straps 30 are optional and their structure may be identical to the straps 28 along the lateral edges, except that they are oriented vertically rather than horizontally. The crossbrace straps 30 are secured by stitching to the interior of starter panel 20 on the inner surface. The crossbrace straps 30 are desirable for providing maximum tautness to the panel 20. Both the straps 28 and the crossbrace straps 30 may be sized and arranged on the inner surface of the panels 20, 22 to suit the particular configuration and structure of the scaffold being enclosed.

The starter panel 20 has a plurality of fastener means on its inner and outer surfaces for joining adjacent panels thereto. Specifically, each starter panel 20 has affixed to its outer surface a fastener 32 along the first lateral edge, a fastener 33 along the upper edge and a fastener 34 along the second lateral edge. Additionally, the starter panel 20 has a fastener 35 on the inner surface along the lower edge. The fasteners 32, 33, 34, 35 are preferably hook and loop closures in the form of continuous strips, which are adhesively bonded, stitched or both to each respective edge. Generally, the fasteners 32, 33, 34 on the outer surface of the starter panel 20 are one portion of the hook and loop closure, and the fastener 35 on the inner surface is the other portion of the hook and loop closure.

Figure 2:
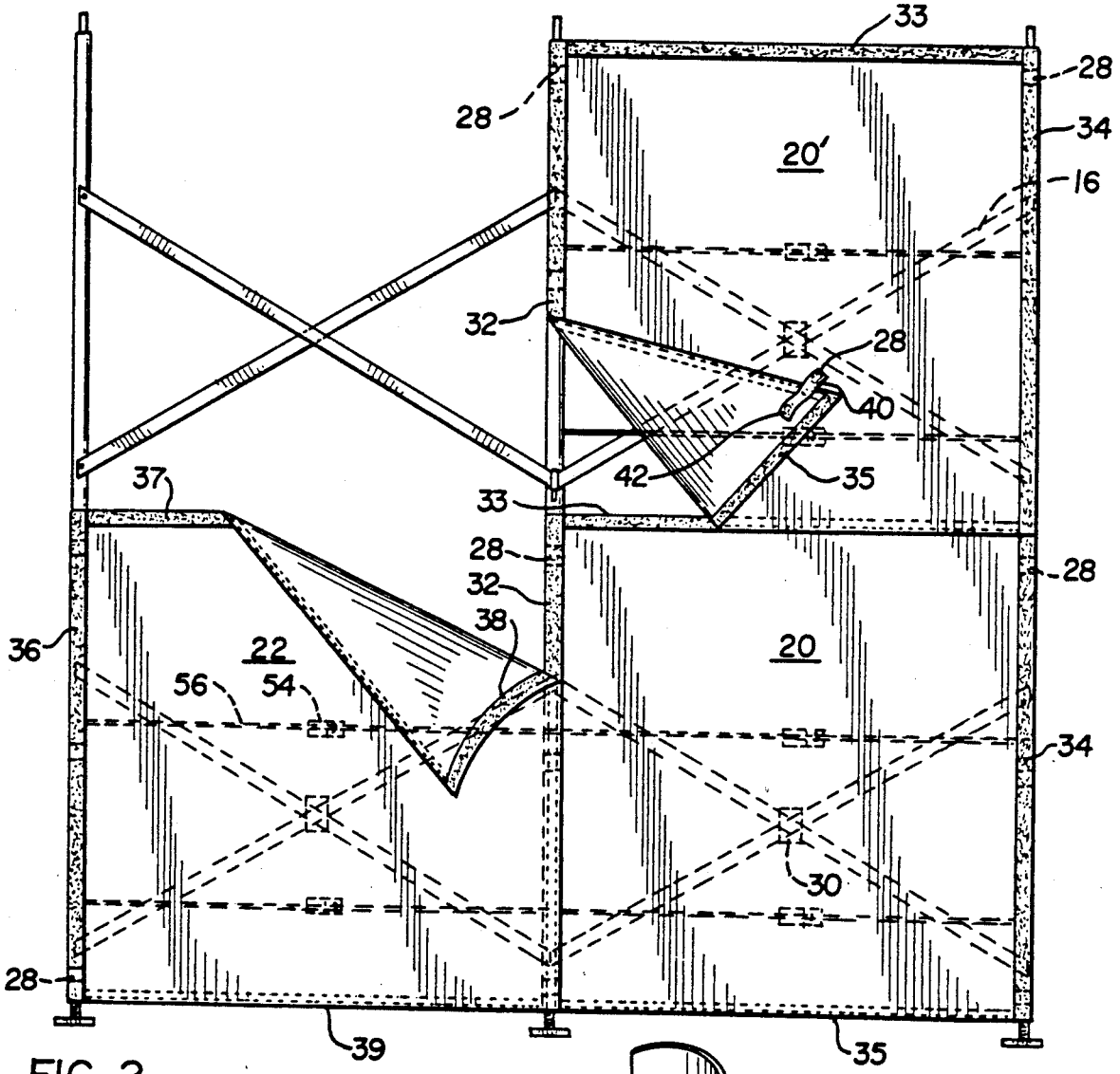
FIG. 2 is an outside view of the enclosed scaffolding shown in FIG. 1 being installed.

Referring to FIG. 2, the continuing panel 22 is similar to the starter panel 20 except that on the outer surface it has a fastener 36 at the first lateral edge and a fastener 37 at the upper edge, and on the inner surface it has a fastener 38 at the second lateral edge and a fastener 39 at the lower edge. These fasteners are likewise in the form of strips as described for the starter panels 20 with the fasteners 36, 37 on the outer surface being one portion of a hook and loop closure and the fasteners 38, 39 on the inner surface being the other portion.

The continuing panel 22 has straps 28 located on its inner surface at the first lateral edge only. Straps are not needed at the second lateral edge because fastener 38 on the inner surface at the second lateral edge is applied to fastener 32 on the outer surface at the first lateral edge of an adjacent starter panel 20, or to fastener 36 on an adjacent continuing panel 22. This reduces manufacturing costs and expedites the set-up procedure.

It will be understood that closure means other than the hook and loop closures shown may be utilized on the panels 20, 22 and the straps 28, 30, such as snaps or belt and buckle closures. The particular advantages provided by the hook and loop closure include simple and fast securement of the straps 28 to the outer uprights 14 and the ability of the straps 28 to conform to a wide variety of outer uprights 14 having various outer dimensions and shapes. The hook and loop fasteners along the panel edges provide for completely sealed seams when the panels are installed. Additionally, hook and loop closures having plastic construction provide optimal weather-resistance as compared to other fasteners utilizing metal or fibrous constituents.

Referring to FIGS. 3 and 4, a lower skirt 50 may be attached to the fasteners 35, 39 on the lower edge of each panel 20, 22, which is secured to the bottom-most row of scaffolding. For this purpose, the lower skirt has a fastener 45 on its outer surface at the upper edge. The lower skirt 50 extends from the lower edge to a base 52 upon which the scaffolding is mounted, normally at ground level. The lower skirt 50 adds a concave surface which directs water away from the scaffolding and prevents it from flowing underneath.

Additionally, FIGS. 3 and 4 show a safety loop 54 which may be placed in both the upper and lower regions of the inner surface at the interior of each panel 20, 22 for receiving two safety cables 56. The safety cables 56 are tightly secured to opposite ends of the scaffolding 10 for providing added protection against the falling of equipment or workers from the work space. The safety cables 56 also provide further support in keeping the panels 20, 22 snug against the scaffolding units 12 in windy weather conditions. Each safety loop 54 has an anchor 58, which is secured with double-stitching to the inner surface, and an integral flap 60 with a central opening 62 for receiving the safety cables 56. The central opening may be equipped with a grommet 64 made from brass, plastic or any other durable substance to prevent tearing of the flap and to prolong the useful life of the safety loop 54.

The panels 20, 22 may be dimensioned to enclose single units 12 of scaffolding or, alternatively, they may be elongated to enclose several units 12 which are stacked on top of one another. The panels 20, 22 may also be designed to form roofing over the scaffolding. The width of the panels 20, 22 may be varied to suit the particular use desired.

To install the scaffold enclosure 18, the starter panel 20 is first secured to a unit of scaffold 12, as shown in FIG. 3. The inner surface of the starter panel, having the straps 28 and the safety loops 54 thereon, is directed toward the scaffolding. The first and second lateral edges are aligned with uprights 14, and each strap 28 is secured to its corresponding upright 14. When the first flap 40 is folded over one of the outer uprights 14 and the second flap 42 is folded on top of the first flap 40, the strap 28 is securely fastened to the outer upright 14 by the hook and loop closure. Likewise, the crossbrace strap 30 is secured to the crossbraces 16.

As shown in FIG. 2, further panels are attached to the starter panel 20 at its first lateral edge and its upper edge. The fastener 38 on the inner surface at the second lateral edge of a continuing panel 22 is placed on the fastener 32 on the outer surface at the first lateral edge of the starter panel 20. The continuing panel 22 is then extended across an adjacent scaffold, and the straps 28 on the inner surface at the first lateral edge of the continuing panel 22 are secured to another outer upright 14. The fastener 38 on the inner surface at the second lateral edge of a further continuing panel 22 (not shown) may then be placed on the fastener 36 on the first lateral edge of the continuing panel 22 in an identical manner to that just described. This may be repeated until a bottom-most row of scaffolding is completely enclosed.

To start a next row of enclosures on top of the bottom-most row, the fastener 35 on the inner surface at the lower edge of a second starter panel 20' is placed on the fastener 33 on the outer surface at the upper edge of the first starter panel 20. The first and second lateral edges are aligned with the uprights 14, and the straps 28 are secured thereto. The fastener 38 on the second lateral edge of another continuing panel 22' is placed on the fastener 32 on the first lateral edge of the starter panel 20'. Additionally, the fastener 39 on the lower edge of the continuing panel 22' is placed on the fastener 37 on the top edge of the continuing panel 22 shown. Continuing panels are further added as needed. Each successive row of panels 20, 22 is thus installed until the scaffold is completely enclosed.

If the optional crossbrace straps 30 are utilized, they are secured to the crossbraces 16 at their point of intersection as shown in FIG. 3. This is done in a manner identical to securement of the straps 28 to the outer uprights 14. The safety cables 56 are threaded through the optional safety loops 54 after the entire enclosure 18 has been put in place.

Thus, the following advantages may be realized when using a preferred embodiment of the scaffold enclosure of the present invention:

1. The canvas construction of the enclosure is lightweight, fireproof, waterproof, rot resistant and has significant strength;
2. The hook and loop closure is simple to secure, thus reducing set-up time and eliminating the need to hire special crews or to use special equipment in order to erect the scaffold enclosure;
3. The canvas is easy to repair as are the various straps and strips of hook and loop closure material;
4. The panels are versatile and may be sized to fit many particular applications;
5. The hook and loop seams are easy to open when the workmen desire to open the enclosure for various purposes, such as letting in fresh air;
6. The various straps are simple to manipulate and are of durable long-lasting construction;
7. The hook and loop closures at the panel edges may be completely sealed to provide maximum weather resistance along the entire length of each seam of the enclosure; and
8. The overlapping of the lower edge of a first panel on the outer surface of a second panel below the first panel, similar to the placement of shingles on a roof, insures that water running down the enclosure will not enter those seams.

Having described the presently preferred embodiments of the invention, it will be understood that it is not intended to limit the invention except within the scope of the following claims.

I claim:

1. A panel adapted to be mounted on a scaffold which includes a pair of spaced, vertical outer uprights, said panel comprising:

a rectangular web having an inner surface, an outer surface, an upper edge, a lower edge and first and second lateral edges, said web dimensioned to extend between the outer uprights of the scaffold, and said lateral edges adapted to engage said outer uprights;

closure means on the inner surface of said web along said first lateral edge for securing said web to at least one of said outer uprights;

fastener means on the outer surface of said web along said first lateral edge for fastening an adjacent panel to said first lateral edge; and fastener means along said second lateral edge for fastening said web to either another of said outer uprights or to an adjacent panel.

2. The panel of claim 1 wherein said fastener means along said second lateral edge includes closure means on the inner surface of said web for securing said web to another of said outer uprights and further includes a fastener on the outer surface of said web for fastening an adjacent panel to said second lateral edge.

3. The panel of claim 2 further including a fastener on the outer surface of said web along said upper edge for fastening an adjacent panel thereto and further including a fastener on the inner surface of said web along said lower edge for fastening an adjacent panel thereto.

4. The panel of claim 3 wherein said fasteners on the outer surface of said web are one of the hook or loop portion of a hook and loop closure and said fasteners on the inner surface of said web are the other of the hook or loop portion of a hook and loop closure.

5. The panel of claim 1 wherein said fastener means along said second lateral edge includes a fastener on the inner surface of said web for fastening said web to an adjacent panel.

6. The panel of claim 5 further including a fastener on the outer surface of said web along said upper edge for fastening an adjacent panel thereto and further including a fastener on the inner surface of said web along said lower edge for fastening an adjacent panel thereto.

7. The panel of claim 6 wherein said fasteners on the outer surface of said web are one of the hook or loop portion of a hook and loop closure and said fasteners on the inner surface of said web are the other of the hook or loop portion of a hook and loop closure.

8. The panel of claim 1 wherein said closure means is a strap closure including a first flap and a second flap, each flap having an inner surface and an outer surface, with one flap carrying one portion of a hook and loop closure on its inner surface and with the other flap carrying the other portion of a hook and loop closure on its outer surface.

9. The panel of claim 1 further including a central closure means on said inner surface at the interior of said web for securing said panel to a crossbrace fixed to said outer uprights and extending therebetween.

10. The panel of claim 1 further including at least one safety loop on said inner surface at the interior of said web and having an anchor secured to said web and a flap with a central opening therein for receiving a safety cable.

11. An enclosure for a scaffolding wherein each scaffold includes a pair of spaced, vertical outer uprights, said enclosure comprising:

a starter panel having an inner surface, an outer surface, an upper edge, a lower edge and first and second lateral edges, said starter panel dimensioned to extend between the outer uprights of the scaffold, said first and second lateral edges adapted to engage said outer uprights;

closure means located on the inner surface of said starter panel at said first and second lateral edges for securing said starter panel to said outer uprights;

fasteners on the outer surface of said starter panel at said first and second lateral edges and said upper edge, and on the inner surface at said lower edge for fastening adjacent panels to said starter panel at each of said edges; and at least one continuing panel dimensioned to extend between the outer uprights of another of said scaffolds, said continuing panel having fasteners on its outer surface at said first lateral edge and said upper edge and on its inner surface at said second lateral edge and said lower edge for fastening adjacent panels to said continuing panel at each of said edges, said second lateral edge engageable on said first lateral edge of said starter panel, said continuing panel further having closure means on its inner surface at said first lateral edge for securing said continuing panel to another of said outer uprights.

12. The enclosure of claim 11 wherein said fasteners on the outer surfaces of both said starter panel and said continuing panel are one portion of a hook and loop closure, and wherein said fasteners on the inner surfaces of said starter panel and said continuing panel are the other portion of a hook and loop closure.

13. The enclosure of claim 11 wherein said closure means is a strap closure including a first flap and a second flap, each flap having an inner surface and an outer surface, with one flap carrying one portion of a hook and loop closure on its inner surface and with the other flap carrying the other portion of a hook and loop closure on its outer surface.

14. The enclosure of claim 11 further including at least one safety loop on the inner surface at the interior of each panel, each of said safety loops having an anchor secured to said panel with a flap having a central opening therein for receiving a safety cable.

15. The enclosure of claim 11 further including a central closure means on the inner surface at the interior of each panel for securing each panel to a crossbrace fixed to said outer uprights and extending therebetween.

16. The enclosure of claim 11 further including a skirt having a fastener on its outer surface for fastening said skirt to the lower edge of each panel in a bottom-most row of panels, said skirt adapted to extend downward from said lower edges to a base upon which said scaffolding is erected.

17. An enclosed scaffolding, comprising:

an array of scaffolds, each scaffold comprising a pair of spaced, vertical outer uprights;

at least one starter panel having an inner surface, an outer surface, an upper edge, a lower edge and first and second lateral edges, said panel being substantially rectangular and extending between the outer uprights of one of said scaffolds, said first and second lateral edges engaging said outer uprights;

at least one strap located on the inner surface of said starter panel at each lateral edge having a first flap and a second flap, each flap having an inner surface and an outer surface, with one flap carrying one portion of a hook and loop closure on its inner surface and with the other flap carrying the other portion of a hook and loop closure on its outer surface;

fasteners on the outer surface of said starter panel at said first and second lateral edges and said upper edge, and on the inner surface at said lower edge for fastening adjacent panels to said starter panel at each of said edges, said fasteners on the outer surface including one portion of a hook and loop closure with the fastener on the inner surface including the other portion of a hook and loop closure; and at least one continuing panel, said continuing panel being substantially rectangular and having an inner surface, an outer surface, a first lateral edge, a second lateral edge, an upper edge and a lower edge and extending between the outer uprights of another of said scaffolds, said continuing panel having fasteners on its outer surface at said first lateral edge and said upper edge and on its inner surface at said second lateral edge and said lower edge for fastening adjacent panels to said continuing panel at each of said edges, said fasteners on the outer surface including one portion of a hook and loop closure with the fasteners on the inner surface including the other portion of a hook and loop closure, said second lateral edge of said continuing panel engageable on said first lateral edge of said starter panel, said continuing panel further having at least one strap on its inner surface at said first lateral edge for securing said continuing panel to another of said outer uprights, said strap having a first flap and a second flap, each flap having an inner surface and an outer surface, with one flap carrying one portion of a hook and loop closure on its inner surface and with the other flap carrying the other portion of a hook and loop closure on its outer surface.

18. The enclosed scaffolding of claim 17 wherein said starter panel has three straps on each lateral edge and said continuing panel has three straps on said first lateral edge.

19. The enclosed scaffolding of claim 17 further including a skirt having a fastener on its outer surface for fastening said skirt to the lower edge of each panel in a bottom-most row of panels, said skirt adapted to extend downward from said lower edges to a base upon which said scaffolding is erected.

* * * * *